United States Patent [19]

DiMatteo et al.

[11] Patent Number: 4,941,220

[45] Date of Patent: Jul. 17, 1990

[54] PATIENT CARE AND TRANSFER ARRANGEMENT

[75] Inventors: Paul DiMatteo, Dix Hills; Charles F. Chubb, Brookville; Robert Segnini, Stony Brook, all of N.Y.

[73] Assignee: Nova Technologies, Inc., Hauppauge, N.Y.

[21] Appl. No.: 232,030

[22] Filed: Aug. 15, 1988

Related U.S. Application Data

[63] Continuation-in-part of Ser. No. 731,533, May 7, 1985, Pat. No. 4,776,047.

[51] Int. Cl.[5] ..... A61G 7/06

[52] U.S. Cl. ..... 5/81 R; 5/81 B; 5/453

[58] Field of Search ..... 5/60, 81 R, 81 C, 453, 5/455, 409, 480

[56] References Cited

U.S. PATENT DOCUMENTS

| | | | |
|---|---|---|---|
| 716,886 | 12/1902 | Goode | 5/81 B |
| 3,822,425 | 7/1974 | Scaks // | 5/469 X |
| 4,638,519 | 1/1987 | Hess | 5/469 X |
| 4,745,647 | 5/1988 | Goodwin | 5/469 X |
| 4,787,104 | 11/1988 | Crantham | 5/81 C X |
| 4,797,960 | 1/1989 | Vaiana et al. | 5/81 B X |
| 4,819,283 | 4/1989 | DiMatteo et al. | 5/81 B X |

FOREIGN PATENT DOCUMENTS

| | | | |
|---|---|---|---|
| 1440193 | 9/1973 | United Kingdom | 5/455 |

*Primary Examiner*—Michael F. Trettel
*Attorney, Agent, or Firm*—Max Fogiel

[57] ABSTRACT

A bed has a mattress with a plurality of inflatable air sacs, a low-pressure compressed air blower, a pressure control system, and pipes for carrying gas from the blower to the sacs. A transport sheet extends over the air sacs and is attached to rollers at the ends of the bed. By winding the transport sheet on one roller and unwinding it from another roller, a patient can be moved across the bed and partly onto a wheelchair with its back rest removed. A lift mechanism on the bed raises the person to a seated position on the wheelchair, and the back rest is replaced behind the person.

16 Claims, 17 Drawing Sheets

VIEW A-A / B-B

PATIENT CARE AND TRANSFER ARRANGEMENT

BACKGROUND OF THE INVENTION

The present application is a continuation-in-part of the parent application Ser. No. 731,533 filed May 7, 1985, now U.S. Pat. No. 4,776,047.

Bedridden invalids are often threatened by or suffer from decubitus ulcers. Such invalids are often placed on beds which employ low pressure inflated air sacs, usually called air cushions, in place of a conventional mattress to avoid or treat decubitus ulcers. The process of transferring an invalid person from such a bed to a wheelchair or commode often requires the help of two or more assistants. The task frequently requires considerable strength and is a common source of injury to the person being transferred or to the nurse(s) or attendant(s) doing the transfer. These problems are often the major factors that require a patient to be hospitalized or moved to a nursing home, rather than being cared for at home. They also increase the cost of caring for persons in hospitals and nursing homes.

SUMMARY OF THE INVENTION

The parent application describes an arrangement for transferring an invalid person from a bed to a separate horizontal surface through use of a sheet which is pulled over the surface of the mattress by being rolled up on a roller at the foot of the bed and unrolled from a roller at the head of the bed. Subsequent applications describe arrangements for transferring a patient between a bed and a wheelchair.

Accordingly, it is the primary object of the present invention to provide a special wheelchair, which may be a commode or may be convertible to a commode, and a patient care bed which is equipped with controllable low pressure air cushions for treating or preventing decubitus ulcers and also equipped with rollers, a transport sheet, and a lifting mechanism, whereby a patient may be transferred between the bed and wheelchair. The transfer can be done with no effort on the part of the patient and minimal physical strength or skill on the part of an attendant.

In many cases invalid persons can easily be injured when they are being transferred between a bed and a wheelchair, due to such causes as stresses placed on weak bones or decubitus ulcers, or as a result of accidental falling. Accordingly, it is another object of this invention to provide a comfortable and safe method of transfer with minimum stress on the person's body and minimum sliding action which could cause or aggravate decubitus ulcers.

It is still another object of the present invention to provide apparatus that can be installed on or attached to hospital or home-type beds which have low pressure air cushions so that a patient can be transported to a seated position on a wheelchair or a commode, or a toilet at the end of the bed, or to a standing position at the end of the bed.

Additional objects and advantages of the present invention will become evident from the following description of specific embodiments when read in connection with the accompanying drawings.

It is to be understood that the term wheelchair, as used herein, includes commodes.

This present invention is also applicable to transfer onto fixed chairs and seating, such as toilets, and there is no intent to limit the present invention to transfer between a bed and a wheelchair.

DESCRIPTION OF THE PREFERRED EMBODIMENTS

FIGS. 1*a* through 1*h* illustrate schematically the method used to transport a person from a wheelchair to a bed.

Figure 1A:
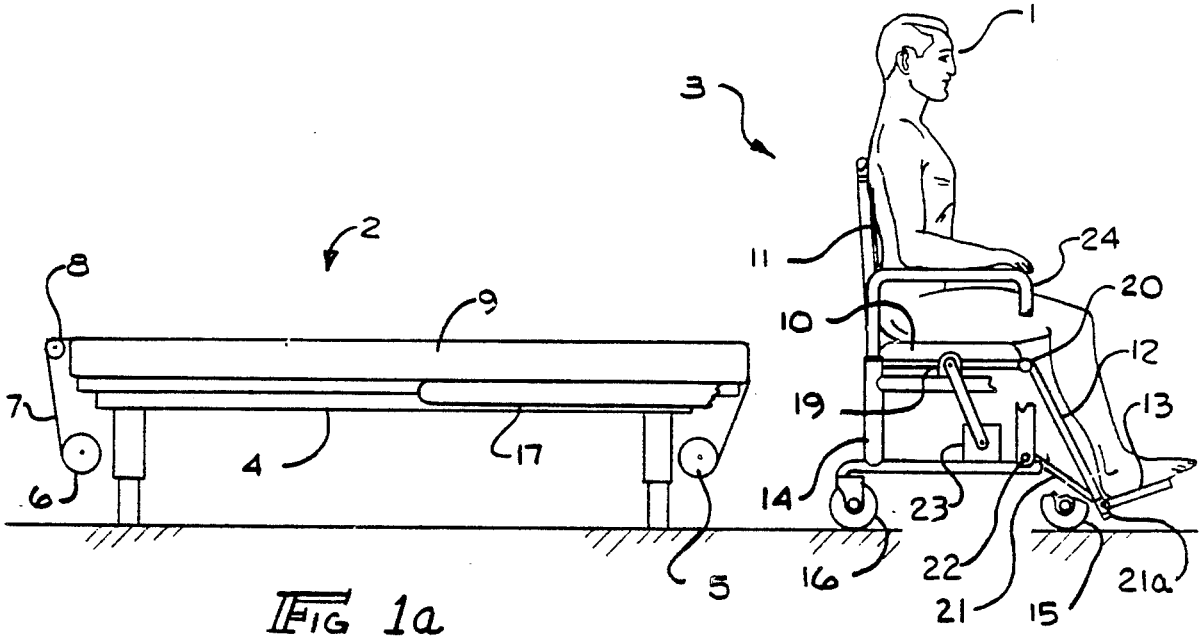
FIGS. 1*a* through 1*h* are schematic sequential views showing the transfer of a person between a wheelchair and a bed.

FIG. 1*a* shows the person 1 seated in a wheelchair 3 ready to be transferred to bed 2. Bed 2 consists of a conventional bed 4, as found in a home or institution such as a nursing home or hospital, with modifications to be described, including variable pressure support cushions. The bed is presumed to be adjusted by conventional means (not shown) to the proper height to perform the required operations.

Attached to the bed 4 is an arrangement for transporting a person longitudinally across the bed. This arrangement contains a front roller 5 whose length is approximately equal to the width of the bed, and which is mounted at the foot-end of the bed. A similar rear roller 6 is positioned at the head-end of the bed. (Head and foot are seen from the patient's point of view.) A transport sheet 7, approximately equal in width to the width of the bed and significantly longer than the bed, is fastened to and partially rolled up on the front roller 5 while the other end is fastened to and partially rolled up on the rear roller 6 at the head-end of the bed. The transport sheet 7 passes over a supporting idler roller 8 between the mattress 9 and rear roller 6.

Electric motors or hand cranks provide mechanical power for driving the two rollers 5 and 6 to wind up the transport sheet 7 on one roller while allowing it to unwind from the other so as to move the sheet, and to thereby transport a person reclining thereon, across the surface of the mattress.

This particular arrangement of rollers is shown to help illustrate the principles of this invention, but the invention is not limited to this configuration, and other arrangements for moving a sheet across a bed to transport a person over the bed can be used equally well.

Also attached to the bed 4, by means not shown, are a pair of mattress lift arms 17, which are described subsequently.

The wheelchair 3 contains a frame 14 supported on front wheels 15 and rear wheels 16, all of which are depicted as small in size. Either pair may be on casters or fixed axles, or the front pair may be large with fixed axles with the other pair on casters. The wheelchair back rest 11, is removably mounted as described subsequently. The seat 10 is rotatably mounted on each side to the frame 14 through seat pivots 19 and is connected to the top of the leg rest 12 through a knee hinge 20. The bottom of leg rest 12 is similarly attached on each side to links 21 through foot pivots 21*a*, and the other ends of links 21 are attached to frame 14 by link pivots 22. An electric motor 23 is coupled to this four-bar linkage at a seat pivot 19, or alternatively at a link pivot 22. The seat 10 is held securely in the normal seating position shown, by a gear train in the electric motor 23 except during transfer operation. A foot rest 13 is attached to the leg rest 12. Optional arm rests 24 are movably attached to frame 14.

Figure 1B:
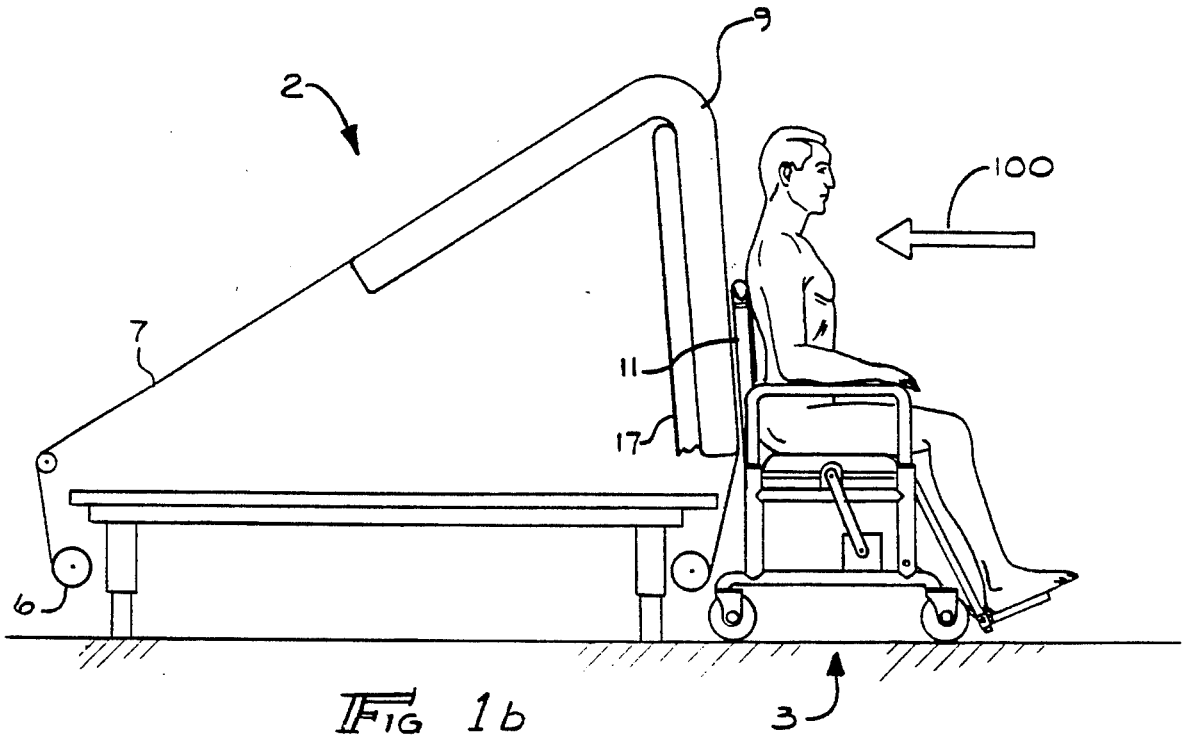

FIG. 1*b* shows the initial transfer steps. The wheelchair 3 has been pushed back, as shown by arrow 100, and latched (by means not shown) to the end of bed 2. The lift arms 17 have been rotated to lift up the mattress 9 to approximately 85 degrees, as shown, with the sheet unrolled as needed from head-end roller 6. With the mattress raised and the wheelchair latched in position, the backrest 11 is unlocked (by means not shown) and is then removable. Alternatively, as described subsequently, the lift arms 17 may raise the transport sheet 7 instead of raising the mattress, as shown in FIGS. 1*b*, 1*c*, and 1*d*.

Figure 1C:
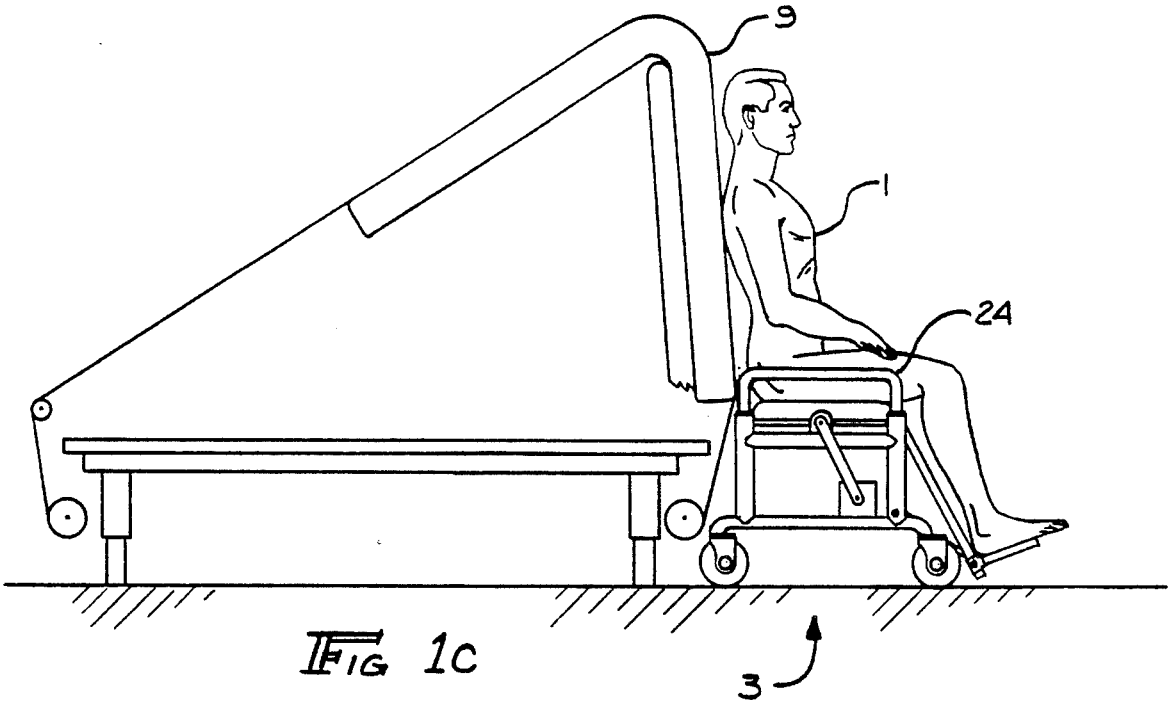

FIG. 1*c* shows the chair 3 with the back rest 11 removed so that the person 1 is resting directly against the mattress 9. The back rest 11 may be completely removed, as shown, or may be lowered, pivoted to the side, or otherwise taken out from behind the person's back. Arm rests 24 optionally may be moved down as shown or otherwise moved away from obstructing the transfer of the person 1.

Figure 1D:
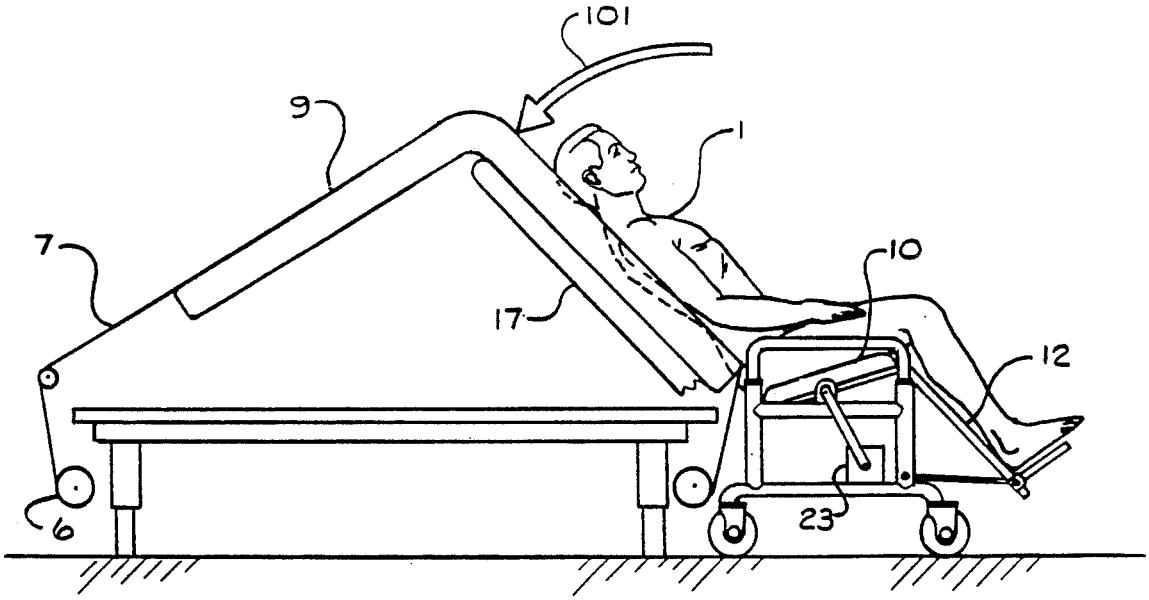

FIG. 1*d* shows the beginning of the actual transfer of the patient by the action of lowering the mattress lift arms 17 which lower the person 1 toward a reclining position as shown by arrow 101. As the mattress is lowered, the motor 23 is energized to rotate the seat 10 approximately 20 degrees and raise the leg rest 12. As mattress 9 moves down, the rear roller 6 is driven to take up slack in the transport sheet 7.

Figure 1E:
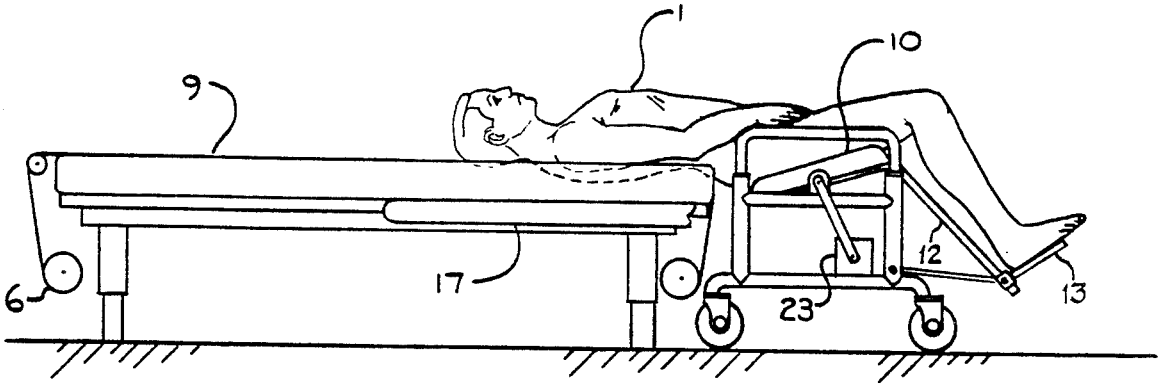

FIG. 1*e* shows the mattress lift arms 17 in their lowered position with the person 1 reclining, partly on the mattress 9. When the lift arms drop below approximately 20 degrees tilt, the sheet 9 starts moving as it is wound on roller 6 and motor 23 is energized again to rotate the seat 10 and raise the leg rest and foot rest 13 to move the patient 1 onto the bed.

Figure 1F:
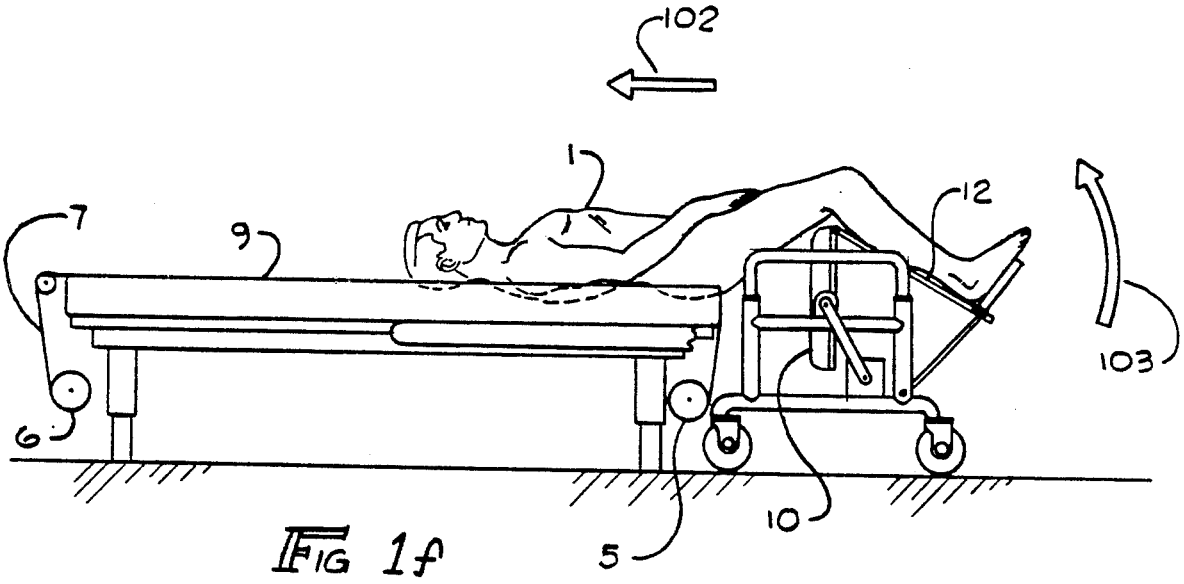

FIG. 1*f* shows, by arrows 102 and 103, the action of the sheet 7 in pulling the person 1 onto mattress 9 as rear roller 6 is driven to wind up sheet 7, drawing it across the mattress 9 from front roller 5. The seat 10 continues to rotate and leg rest 12 moves back toward the mattress.

Figure 1G:
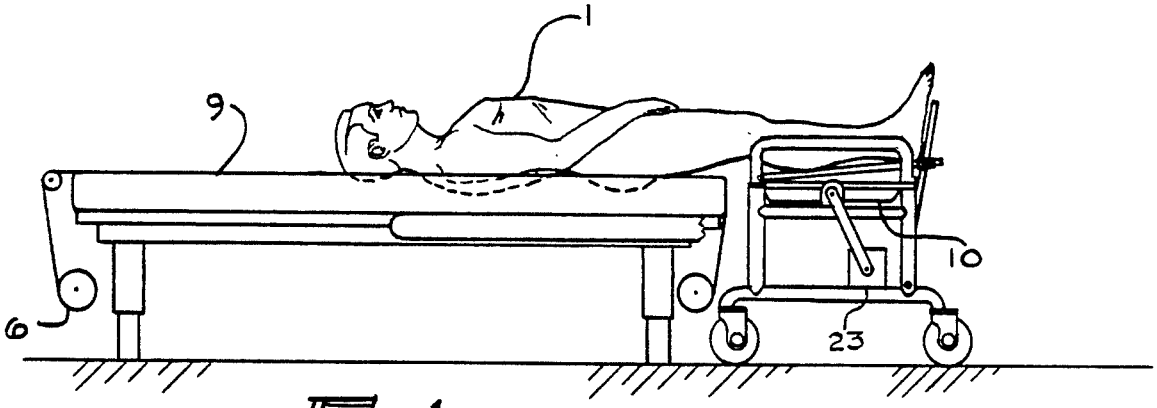
Figure 1H:
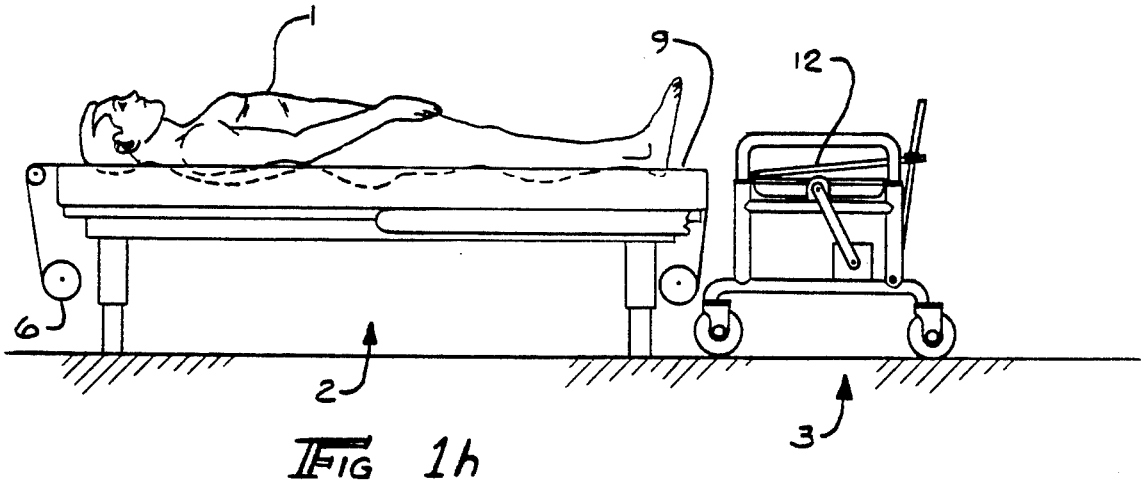

FIG. 1*g* shows seat 10 has been completely rotated to 180 degrees at which time the motor 23 is stopped. Rear roller 6 continues to move the person 1 until he reaches the middle of the mattress 9, as shown in FIG 1*h*. His feet and legs slide across the leg rest 12, which is soft and covered with a smooth slippery material such as nylon, to prevent skin irritation. The wheelchair 3 can then be unlatched and removed from the bed 2, if desired.

By reversing the directions of motion and the order of the above steps, the patient can be transferred back from the bed to the wheelchair as illustrated in FIGS. 1*f* through 1*e*.

Figure 2:
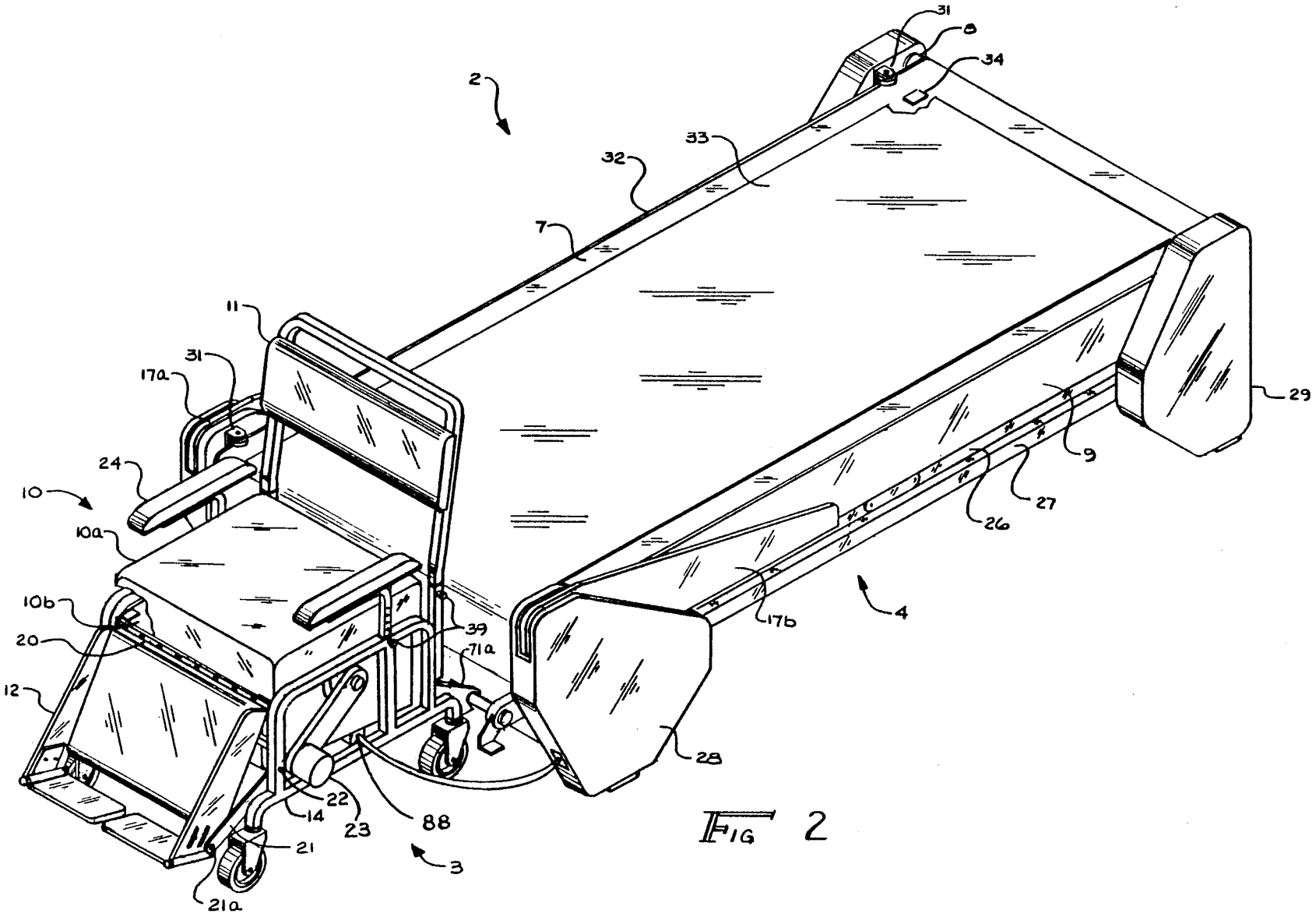
FIG. 2 is a perspective view of the invalid transfer arrangement showing the wheelchair latched to the bed.

FIG. 2 is a perspective view of the invalid transfer arrangement, showing wheelchair 3 latched to the bed. The bed 2 consists of a modified standard hospital-type bed 4, including an articulated frame 26, a support frame 27, and a special mattress 9 which includes variable pressure cushions to be described subsequently and a slippery cover sheet of nylon or similar material to provide a low friction surface over which a transport sheet can slide. At the foot and head ends of the bed, front and rear drive units 28 and 29, respectively, are mounted to the fixed frame 27. These units include front and rear rollers and their drives, which are described subsequently. The front drive unit also includes mattress lift arms 17*a* and 17*b* and their drive unit which are also described subsequently. A transport sheet 7 having a low-friction bottom surface for sliding over the mattress cover sheet extends over the mattress 9 between front and rear rollers in drive units 28 and 29. An idler roller 8, bolted or otherwise fastened to articulated frame 26, supports the transport sheet 7 at the head end of mattress 9. The front and rear drive units 28 and 29 include guide roller units 31 through which pass thickened hems 32 of the transport sheet 7. The thickened hems of the sheet are held at the sides of the bed by guide rollers which guide the transport sheet 7 in an orderly fashion onto the sheet-driving rollers in front and rear drive units 28 and 29. A bed sheet 33 is fastened to transport sheet 7 by sheet fasteners 34 at each corner. These fasteners may consist of strips of press-and-hold, pull-and-release material such as that available commercially under the trade name VELCRO, or other attachment methods may be used, in the form of snaps, zippers, buttons, hooks and eyes, clamps, or the like. The fastener locations may also be different —for example extending along one or more edges of sheet 33.

FIG. 2 shows the wheelchair 3 locked to bed 2 through a chair latch 71*a*. A sprocket on seat drive motor 23 is coupled to the seat 10 as shown, or alternately to the link 21, through a connecting chain and sprockets, not shown. The back rest 11 can be removed and arm rests 24 can be adjusted or removed from the frame 14 by pulling out holding pins 39 on each side of the wheelchair. Electric power for actuating the motor 23 is carried to the wheelchair through cable and connector 88. Leg rest 12 is connected to frame 14 by links 21 through pivots 21*a* and 22, and by hinge 20 to seat 10. Seat 10 is comprised of seat cushion 10*a* removably fastened to seat base 10*b*.

Figure 2A:
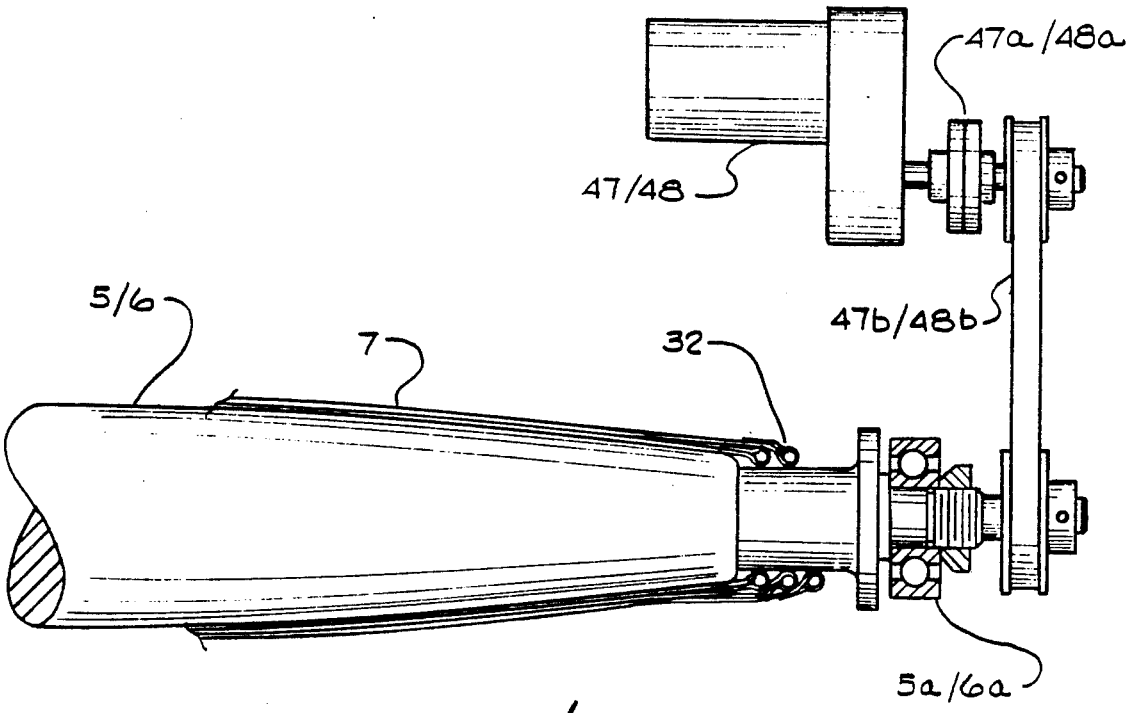
FIG. 2*a* is a partial view of a sheet roller and drive arrangements.

FIG. 2*a* is a partial front view of the front roller 5 rotating on bearings 5*a* in the front drive unit 28 and driven by front sheet drive 47 through front clutch 47*a* and belt 47*b*. A similar roller 6 is used at the rear end of the bed. Front and rear sheet drives 47 and 48, respectively, comprise conventional reversible a–c motors driving through speed reduction gear boxes. Alternatively, variable speed a–c or d–c motor drives may be used to accommodate special patient needs. Front and rear clutches 47*a* and 47*b* can be engaged or disengaged electrically. When either clutch is disengaged, the corresponding sheet roller is free to rotate and the transport sheet 7 can be freely drawn off that roller. When a clutch is engaged, the corresponding sheet roller can be motor-driven and otherwise is held in place by residual friction or by a brake incorporated in the motor.

The front and rear rollers 5 and 6 are thickest in the middle and taper down to a small diameter near both ends to cause the transport sheet 7 and the thickened hem 32 to wind up in an orderly fashion in the end regions of the roller as shown in FIG. 2*a*, and to concentrate the pulling force at the center of the transport sheet where the drag load from the patient is concentrated, thereby preventing the drag load from pulling the edges of the sheet in toward the center of the bed.

Figure 3:
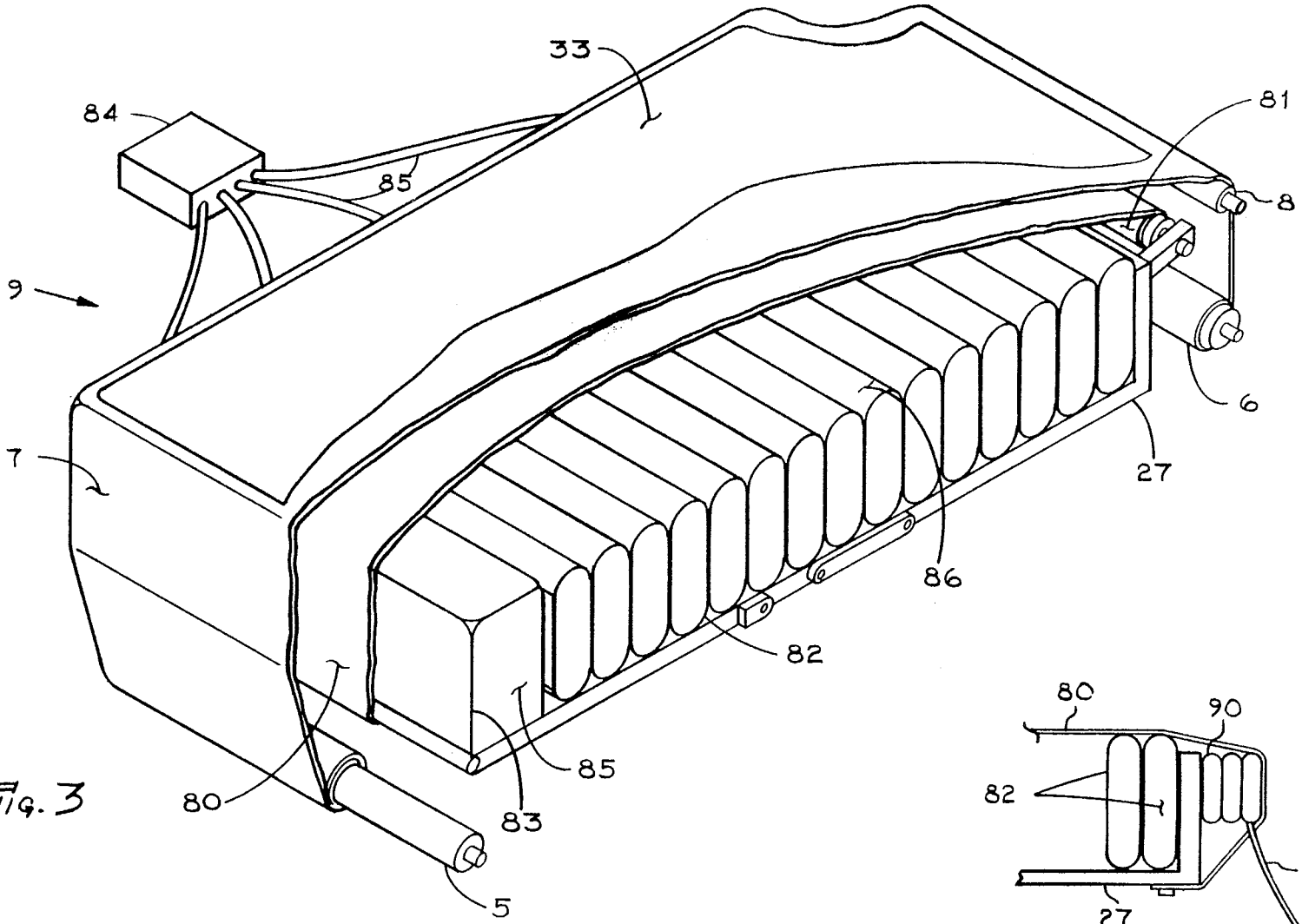
FIG. 3 is a partial perspective view of the bed and mattress showing the arrangement of air cushions.

FIG. 3 shows the arrangement of the mattress 9 and the transport sheet 7 and its drive rollers 5 and 6 and idler roller 8. The mattress 9, which is designed to provide a low-pressure support surface for prevention and treatment of decubitus ulcers (bedsores), contains a number of low-pressure air-filled cushions 82. These cushions are normally inflated to pre-set pressures by means of a pressure control unit 84, which is connected to groups of the cushions through hoses 85. Four such hoses are shown, but any number up to the total number of cushions 82 may be used. The several groups of cushions are manually adjusted by an attendant or nurse to pressures which are suitable for the particular patient. A foot-end cushion 83 which provides support for the cushion 82 at one end of the mattress, may also be air filled, or alternatively, may be filled with polyurethane foam or other flexible foam material. In order to resist deformation from the friction drag force of the transport sheet carrying the weight of a person during transport, the foot-end cushion 83 preferably has a wider top surface than the other cushions, and, if air filled, it may be inflated to a higher pressure than the other cushions 82 by the pressure control unit 84. In order to maintain its shape, the cushion 83 preferably also has spaced along its length internal support panels, similar in shape to the end support panel 85.

Additional support for cushion 83 is provided by the mattress cover sheet 80, which is fastened at the foot end of the bed to the articulated frame 27 and is preferably also fastened to the foot-end cushion 83. Cover sheet 80 extends over the tops of cushions 82 to a cover sheet roller 81 at the head end of the bed. The cover sheet 80 has a slippery top surface, such as nylon, over which the transport sheet 7 can slide. The cover sheet roller 81 is rotatably mounted to the bed support frame 27 and is coupled to a motor, not shown, which is controllable to roll up and tighten the cover sheet 80 so it will support the cushion 83 when a patient is being transported off the mattress and to provide a smooth orderly surface over which the transport sheet can be moved by the drive rollers 5 and 6. Concurrently, the pressure in the cushions 82 and 83 may be automatically increased to pre-set levels by the pressure control equipment 84 to provide a firm patient support during transport.

Figure 5:
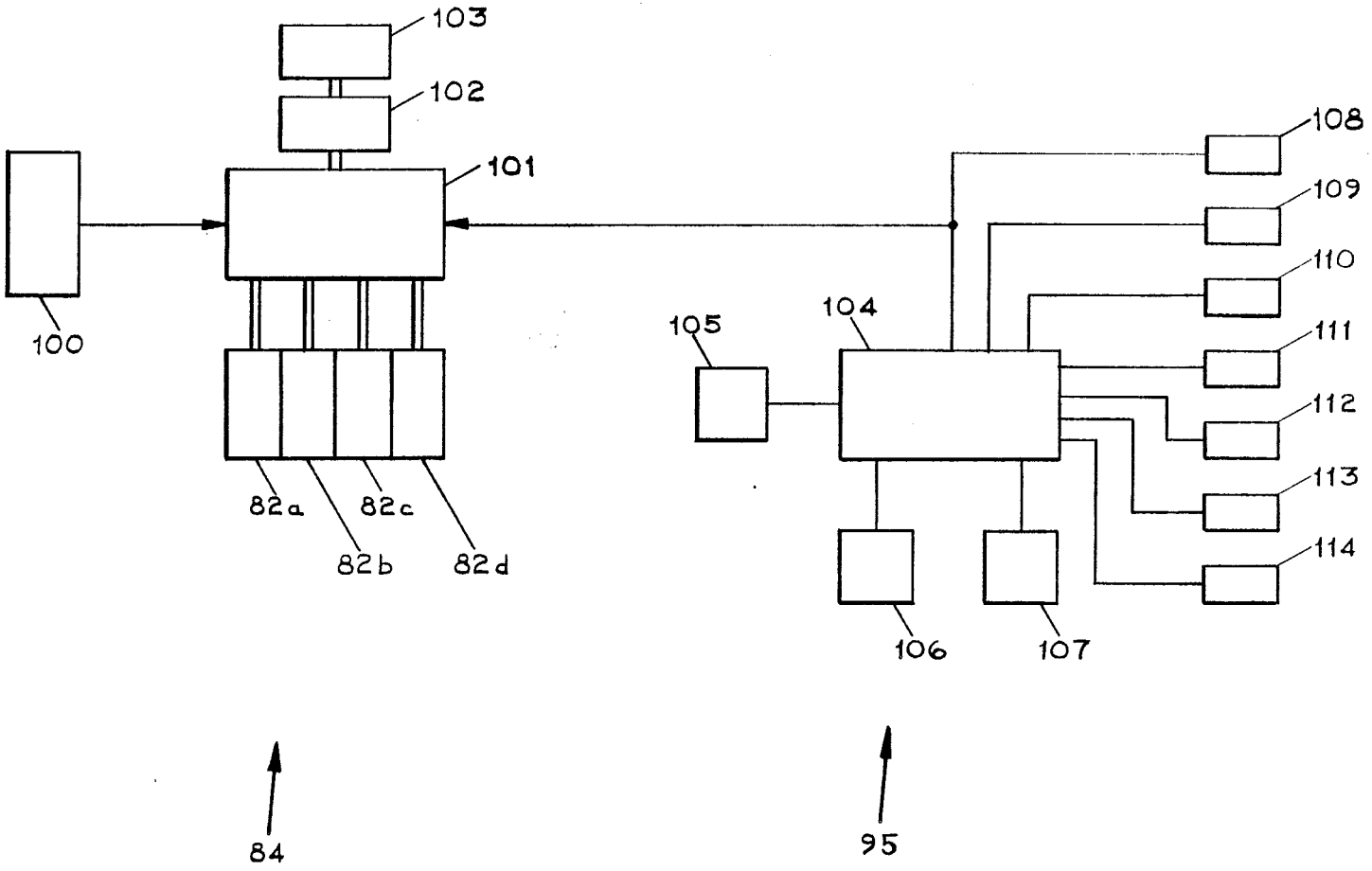
FIG. 5 is a schematic drawing showing the control system for the air cushions, the bed positioning, and the transport function.
Figure 5A:
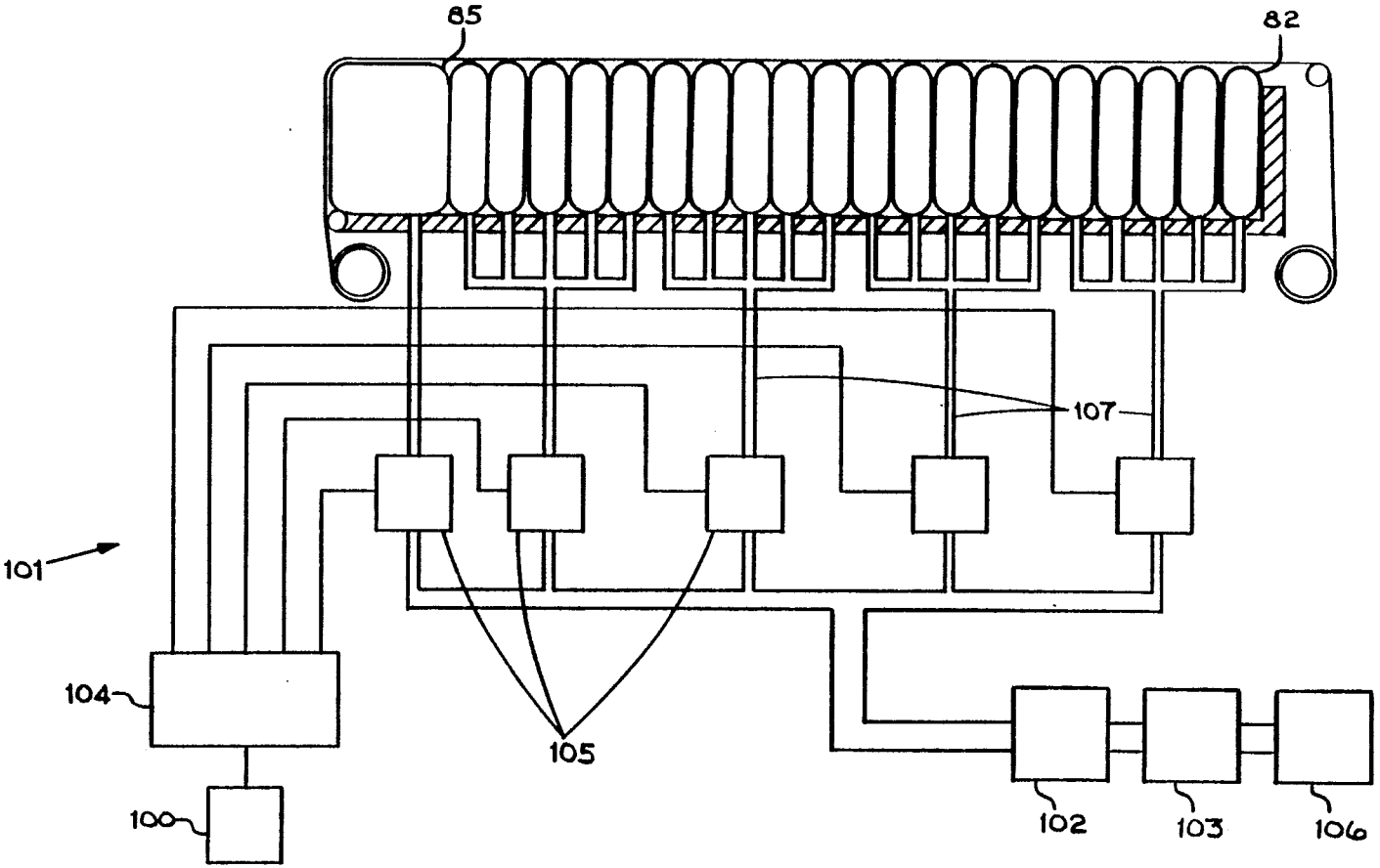
FIG. 5*a* is a schematic drawing showing the arrangement for controlling the pressure in the air cushions.

When a patient is reclining on the mattress 9 and there is no action to move the transport sheet 7 toward the foot end roller 5, the cover sheet roller is controlled to unwind and slacken the mattress cover sheet 80, and the air pressure in the cushions 82 is adjusted to the pre-set patient-care levels, as shown in FIG. 5*a* and described subsequently.

In order to provide some air flow from the cushions for keeping the patient's body dry, it is desirable for the top surfaces 86 of the cushions 82, the mattress cover sheet 80 and the transport sheet 7 to be permeable to air. The transport sheet is preferably made of a microporous fabric which is permeable to air but non-permeable to liquids so that if soiled it can be wiped clean. Such a fabric is available from W.L. Gore and Associates under the trade name GORE-TEX. In this case a patient support pad 33 may be used which may comprise a permeable bed sheet removably attached to the transport sheet 7 as shown in FIG. 2, or it may comprise a pad of moisture-absorbing material. Alternatively, the patient support pad 33 may be impermeable to liquid and permeable to air, and the carrier sheet 7 and the mattress cover sheet 80 may be permeable to both air and water, and either or both may be constructed of loosely worn cloth or netting.

Figure 3A:
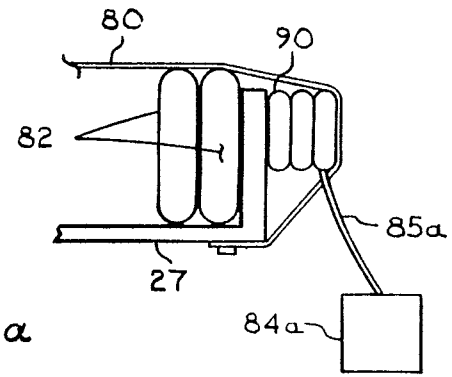
FIG. 3*a* is a partial side view of the air support cushion, showing an air bag for tightening the mattress cover sheet.

FIG. 3*a* shows an alternative configuration using an air bag 90 which is mounted on the bed frame 27 for use in place of the roller 81. The mattress cover sheet 80, which is attached to the bed frame 27 at the head end of the bed, can be tightened over air cushions 82 by inflating the air bag 90 by the pressure control equipment 84*a* through an air hose 85*a*.

Figure 4:
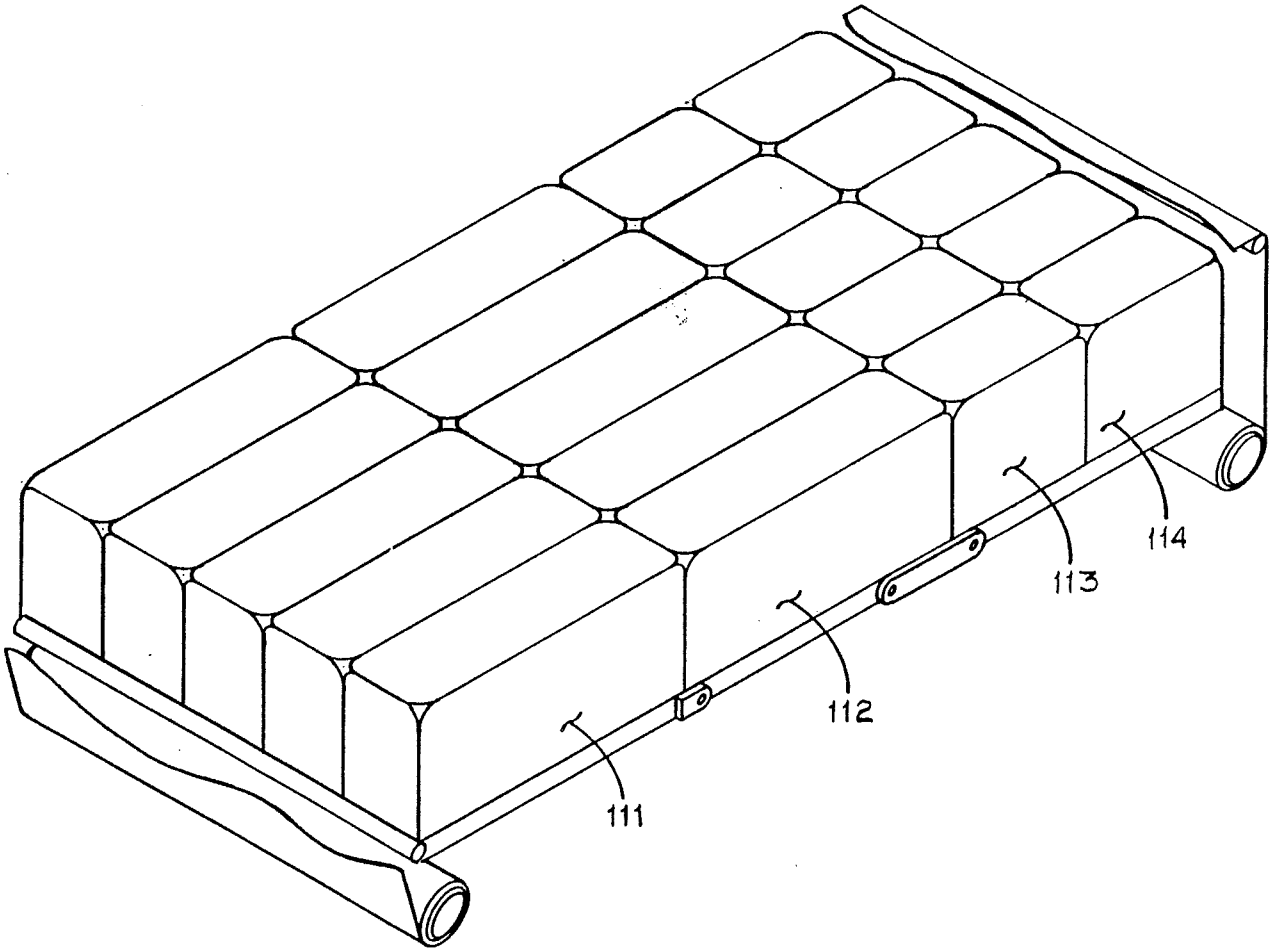
FIG. 4 is a partial perspective view of an alternate arrangement of air cushions.

FIG. 4 shows an alternate arrangement of air cushions which have their major axes parallel to the major axis of the bed. As a typical configuration, a group of five leg support cushions 111 are located side-by-side at the foot end of the bed, and other groups of cushions 112, 113, 114 complete the mattress or sleeping surface of the bed. The top surfaces of adjacent air cushions are preferably attached together by means not shown to provide lateral stability, or side supports on the bed can be used for this purpose. This arrangement of cushions provides good mechanical support against the drag of a transport sheet moving longitudinally over the tops of the inflated cushions, especially for the foot-end cushions 111. It is to be understood that the numbers of cushions used may differ from the numbers shown in FIG. 4.

FIG. 5, is a schematic drawing of the control system, including pressure control equipment 84 and transfer and bed control equipment 95. Groups of air cushions 82*a*, 82*b*, 82*c* and 82*d* are each supplied by air at controlled pressure from a pressure controller 101. Electrically-controlled valves and pressure sensors, which are commercially available and are well known to those familiar with the art, are used to control the air pressure to levels which are selected for patient care at an operator's control panel 100. A pump 103 and a thermostatically-controlled heater 102 provide compressed air to the pressure controller 101. A transfer control logic unit 104 receives input control signals from a patient control pendant 107 and transmits corresponding electrical power to the head elevation motor 114, bed elevation motor 113 and the mattress lift motor 112, or, alternatively, a leg elevation motor, not shown, to operate the bed adjustments which are normally available to a patient on a hospital type bed. The transfer control logic unit 104 also receives signals from an attendant control panel 105 and a transfer pendant 106 and transmits the appropriate electrical power to the above motors 114, 113, 112 and to the drive motor 111, the front and rear end sheet drive motors 110 and 109, the mattress cover sheet motor 108, and a control signal to the pressure controller 101 to increase the cushion air pressure to levels suitable for patient transfer, or reduce the pressure to pre-set levels for patient care. Various sensors which are used in the control system are not shown in FIG. 5*a*, for simplicity.

The logic and control circuitry in the pressure controller 101 and the transfer control logic unit 104 are well known to those skilled in the state of the art and can be implemented with many different types of integrated circuits and other electronic components which are commercially available.

FIG. 5*a* is a simplified schematic drawing of the air cushion mattress and the pressure control system. Intake air enters the air pump 103 through a filter 106 and passes through the heater 102 to air pressure control valves 105. These valves, in combination with a pressure electronic unit which controls them, comprise the pressure controller 101. The controlled-pressure air is distributed through air pipes 107 to individual air cushions 82, including optionally, the foot end support cushion 85. Five valves and twenty-one cushions are shown as an example, but other quantities may be used, and the spatial grouping of cushions may be different. For example, some cushions may be on the left side of the bed and some on the right side of the bed, or the groups of cushions may be interleaved with each other. The pressures in the several groups may be varied with time in accordance with a predetermined program to move the patient or provide desired therapeutic benefits, such as improving circulation to prevent decubitus ulcers. For example, high and low pressures in interleaved groups of air cushions may be interchanged periodically.

Except during patient transfer, the air pressure levels to five groups of cushions are controlled by the pressure electronic unit 104 in accordance with operator commands entered by the operator at the pressure control panel 100. It is to be understood that for simplicity many details of the pressure control system have not been shown in FIG. 5*a*. For example, the pressure control valves 105 may include pressure transducers (not shown) connected to the electronics control unit 104. Although FIG. 5*a* shows only input pipes 107 to the individual air cushions 82, both input and exhaust pipes may be used, and air pressure may be controlled with valves acting in concert on both the input and exhaust lines. So alternatively, each of pipes 107 may represent an input pipe and an exhaust pipe from the several groups of air cushions, and each of pressure control valves 105 may represent a pair of valves, one which regulates input air to the cushions and one which regulates exhaust air from the cushions, with the pair of valves controlled by the pressure electronic unit. A particular use of exhaust valves is to rapidly deflate all cushions in response to an operator command so that a patient can be quickly lowered onto the solid bed surface below the air cushions to enable cardiac pulmonary resuscitation (CPR).

Figure 6A:
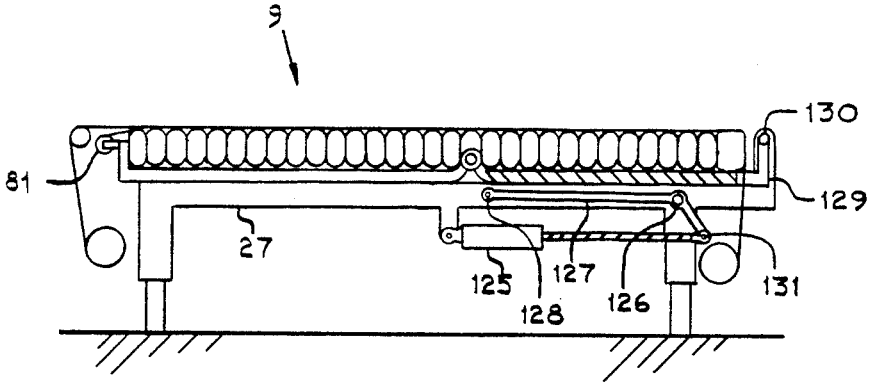
FIGS. 6*a* and 6*b* schematically a mattress lifting arrangement with the mattress lowered and raised, respectively.
Figure 6B:
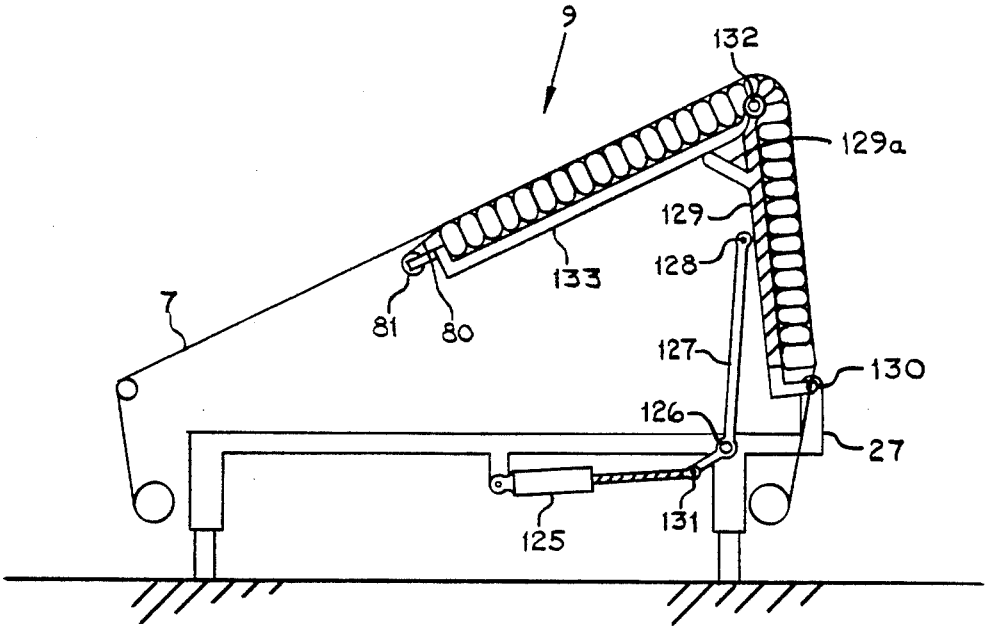

FIGS. 6*a* and 6*b* show an arrangement for raising a person to a sitting position on a wheelchair, as shown in FIG. 1*c*, by raising the air cushion mattress 9. The mattress is lifted by energizing a lift motor linear actuator 125 which provides translational motion and is connected to a link 127 through a pivot 131. The link 127 rotates about a pivot 126 on the bed support frame 27, and a roller 128 on link 127 pushes up a lift member 129 which is connected to the bed support frame 27 through a pivot 130 and supports part of the air cushion mattress 9. FIG. 6*a* shows the mattress 9 in its lowered position. FIG. 6*b* shows the mattress 9 in its raised position. The lift member 129 supports the front part of the mattress 9. A support member 133, which is connected to the lift member 129 by pivots 132 supports the rear part of the mattress 9. In this position, the support member 133 rests on a projection 129*a* on the lift member 129. The projection is not shown in FIG. 6*a*, for clarity. The mattress cover sheet 80 extends over the mattress 9 and is attached to the roller 81 which is mounted on the support member 133. The transport sheet 7 extends over the mattress cover sheet 80.

The connecting air hoses are not shown on these figures but they are flexible for bending and are routed past the pivots 130 and 132 to the several groups of air sacs in the mattress 9.

Figure 7A:
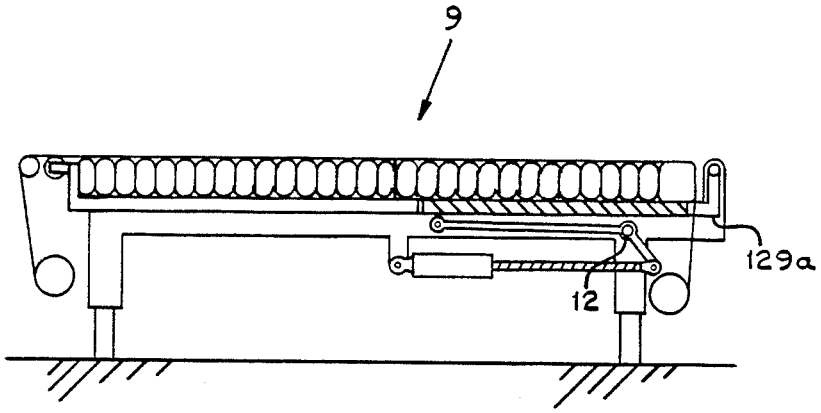
FIGS. 7*a* and 7*b* show a similar arrangement for lifting a section of a two section air cushion mattress.
Figure 7B:
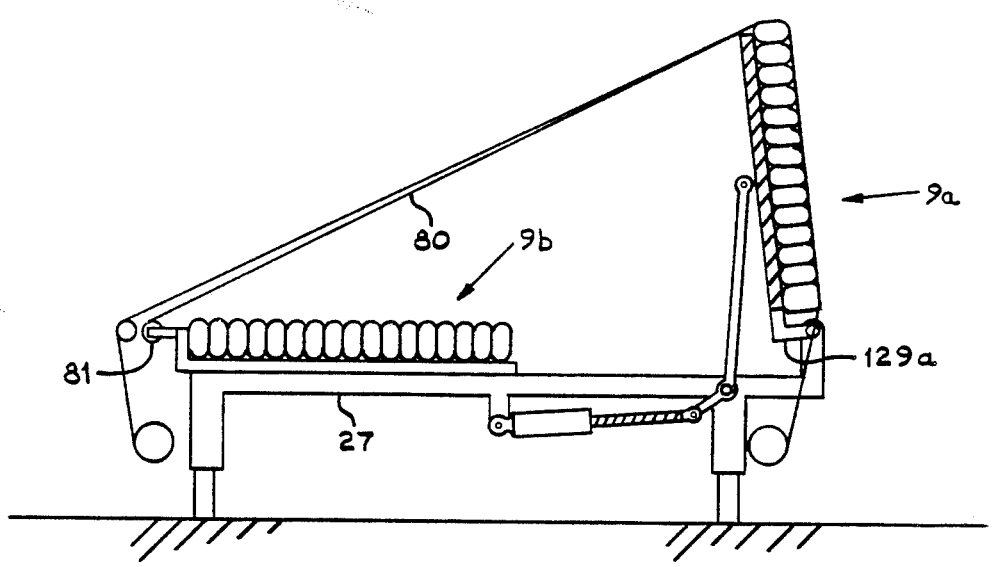

FIGS. 7*a* and 7*b* show still another arrangement for raising a person to a sitting position on a wheelchair (not shown) by lifting a front mattress section 9*a* of the air cushion mattress 9. FIG. 7*a* shows a lift member 129*a* in its lowered position with the same lifting mechanism as in FIG. 7*a* and 7*b*. FIG. 7*b* shows the lift member 129*a* supporting the front mattress section 9*a*. The rear mattress section 9*b* remains in place on the bed frame 27. In this case, the roller 81 unrolls the mattress cover sheet 80 to provide slack as the front mattress section is raised. The air cushion arrangement shown in FIG. 4 is particularly well-suited for this arrangement because of the shapes of the cushions which makes them self supporting when a section comprising two groups of cushions is raised.

Figure 8:
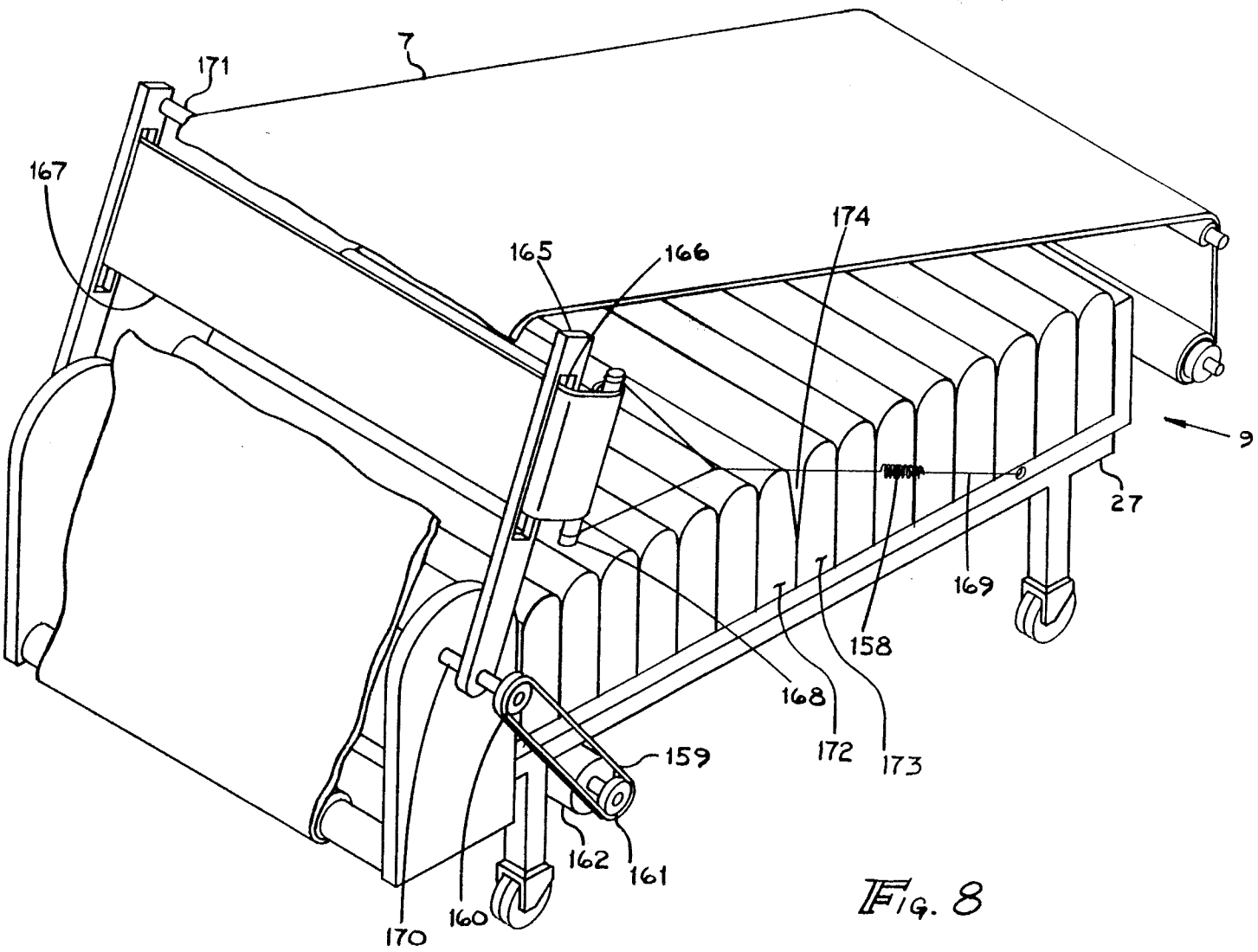
FIG. 8 is a perspective view of the bed showing an arrangement for lifting and pulling taut a support sheet under a transport sheet.

FIG. 8 shows an alternate arrangement for lifting a patient to a sitting position by raising and tightening a support sheet 167 under the transport sheet 7. Lift arms 165 on each side of the bed are rotatably supported at one end by pivots 170. Attached to the lift arms are lift arm sprockets 160 which are driven through chains 159 by sprockets 161. The latter are coupled to and driven on each side of the bed by reversible lift motor 162. The support sheet 167 extends across the mattress 9 between the lift arms 165, which have slots 166 through which both ends of the lift sheet are threaded. The ends of the support sheet 167 are fastened to stiffener bars 168 which prevent the ends of the support sheet from slipping through the slots 166. Tension cables 169 are fastened to the stiffener bars on each side of the bed and are attached through springs 158 to the bed frame 27. When the lift arms 165 are raised by the lift motor 162, the tension cables 169 act to tighten the support sheet 167, which supports the transport sheet 7 and lifts a patient reclining thereon to a sitting position, as shown in FIG. 1*c*. A cross brace 171 connects the two lift arms and supports them against the tension force from the support sheet. When the lift arms 165 are lowered to move a patient from a sitting position on a wheelchair to a reclining position on the bed, the tension cables become slack so that the support sheet is loosened and conforms comfortably with the deflections of the air cushions under the weight of a patient's body. This arrangement does not have a mattress cover sheet, and when the lift arms are lowered, the cross brace 171 moves down between two air cushions 172 and 173 which are appropriately shaped and positioned to provide a gap 174 for this purpose, and which may be forced apart as the cross brace is lowered.

Figure 9:
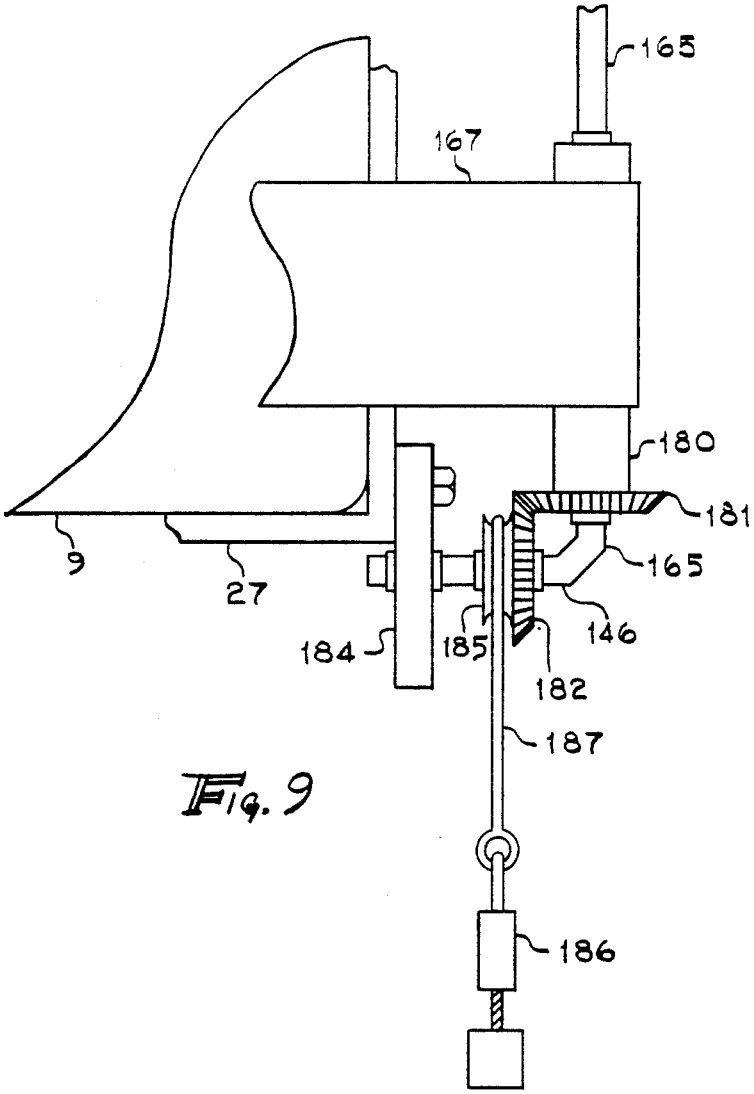
FIG. 9 is a partial top view of another arrangement for lifting and pulling taut a support sheet under a transport sheet.

FIG. 9 is a partial top view of the mattress 9, and shows another arrangement for raising and tightening a support sheet 167. The lift arms 165 on each side of the bed are attached to pivot shafts 146 which are rotatably supported in a support frame 184, attached to the bed frame 27. The support sheet 167 is attached to and partially wound on a sleeve 180 which is rotatably mounted on the lift arm 165. The sleeve 180 is attached to a beveled gear 181 which meshes with a bevel gear 182, rotatably mounted on the pivot shaft 146 and attached to a drum 185. A cable 187 is fastened to and partly wound on the drum 185 and is attached at its other end to a linear actuator 186. The linear actuator can be energized to pull the cables 187, thereby rotating the sleeves 180 and winding up the support sheet 167 on each side of the bed. When the support sheet is taut, a further pulling of cable 187 raises the lift arms 165 and the support sheet 167.

Figure 9A:
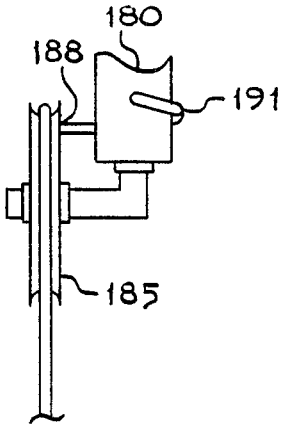
FIG. 9*a* is a partial top view of an alternate arrangement for pulling and lifting a support sheet.

FIG. 9*a* shows that, alternatively, the bevel gears 181 and 182 can be replaced by a second cable 191 attached to and partly wound on the sleeve 180 and attached to the drum 185 at point 188, so that rotating the drum 185 pulls on the second cable and rotates the sleeve 180.

Figure 10A:
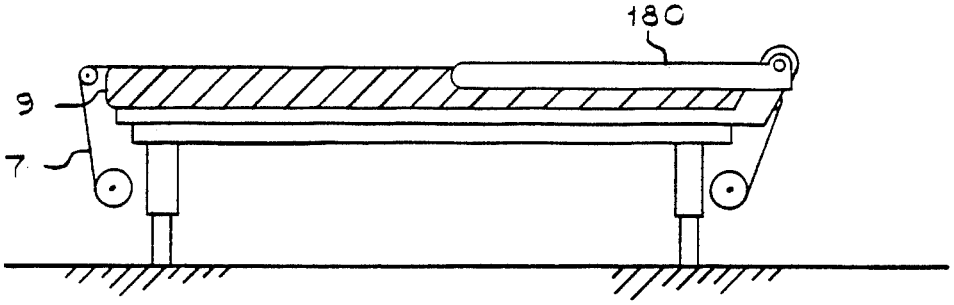
FIGS. 10*a* and 10*b* show schematically an arrangement for lifting a transport sheet, with the lift arms down and up, respectively.
Figure 10B:
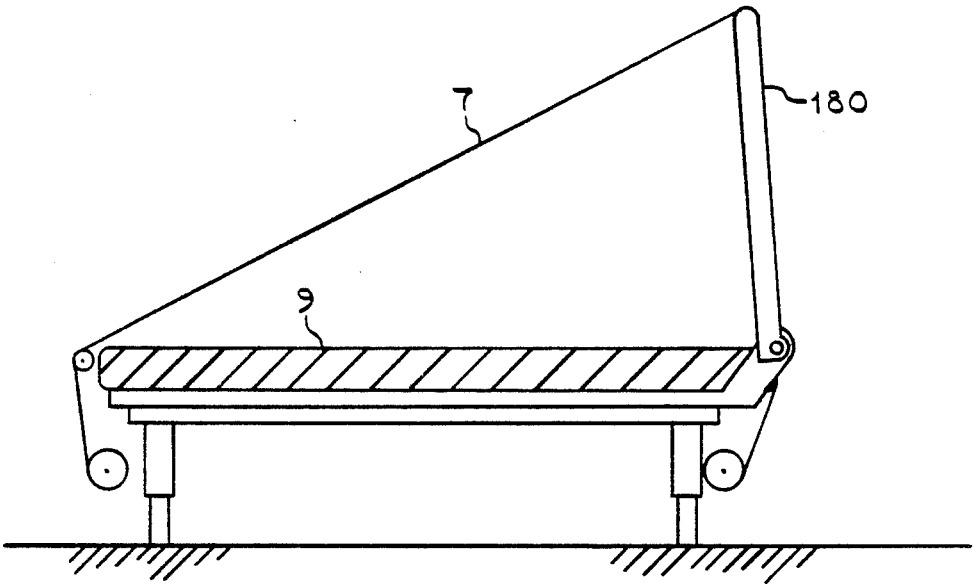

FIGS. 10*a* and 10*b* show schematically another arrangement for raising the carrier sheet 7 to a vertical position for moving a patient to a sitting position on a wheelchair, as shown in FIG. 1*c*. Lift arms 180 on each side of the mattress 9 are coupled to and raised by a motor, as shown in FIG. 8. The transport sheet 7 is lifted by the lift arms.

Figure 10C:
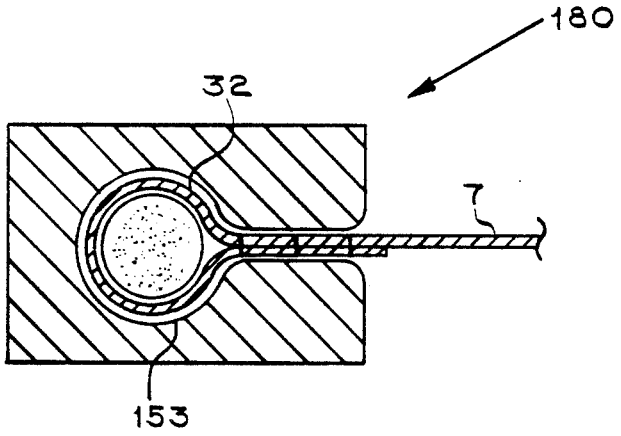
FIG. 10*c* a cross-sectional view through a lift arm, showing a method of supporting the transport sheet using a thickened hem in a shaped groove.

FIG. 10*c* is a cross-sectional view of a lift arm 180. It shows that the transport sheet 7 has a thickened hem 32 which slides along a groove 153 in the lift arm 180. When the lift arm is raised by motion of a lifting member, not shown, the transport sheet 7 is lifted by the thickened hem which is captured in the groove 153. Alternatively, motion of a lifting member may first move a clamp member to clamp the transport sheet hem to the lift arm and then may raise the lift arm and the transport sheet clamped to it.

Figure 11:
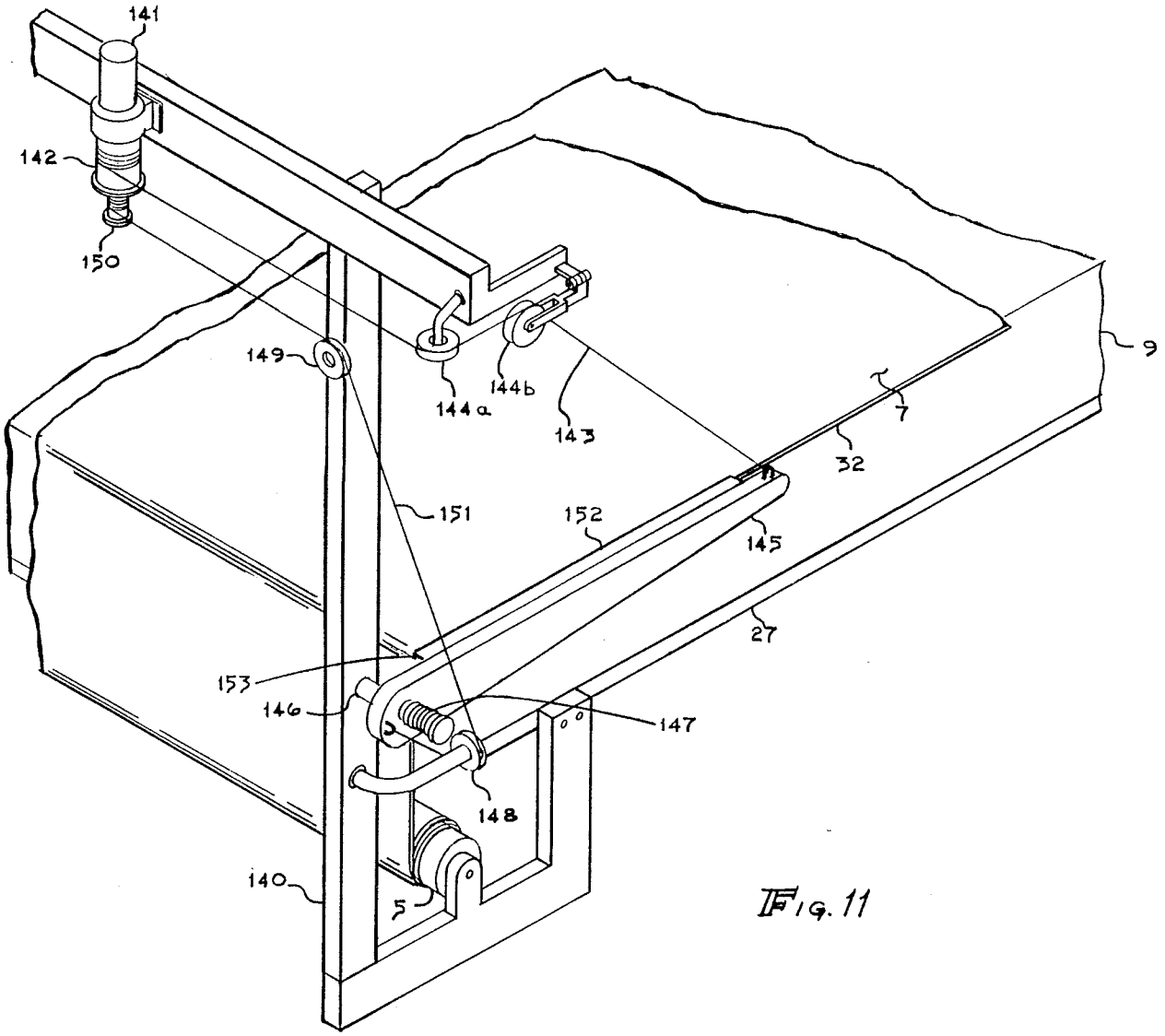
FIG. 11 is a partial perspective view of an arrangement for lifting and pulling taut a transport sheet.

FIG. 11 is a partial perspective view showing another arrangement for lifting a patient to a sitting position in a wheelchair by lifting and lightening the transport sheet. A lift arm 145 on each side of the mattress 9 is each rotatably and slidably supported at one end on a pivot shaft 146 which is mounted on a lift support frame 140. At its other end, each lift arm 146 is attached to a lift cable 143 which passes over pulleys 144*b* and 144*a* and is attached to and wrapped around a lift drum 142 mounted on the lift frame 140. Energizing a lift motor 141, coupled to the lift drum 142, winds up the lift cable 143 and raises the lift arm 145, which pivots about the pivot shaft 146. Since the pulley 144*b* is mounted beyond the edge of the mattress 9, the cable 143 pulls the lift arm 145 laterally away from the bed as the lift arm is raised to a substantially vertical position. A spread cable 151 is attached to each lift arm 145 in the vicinity of the pivot shaft 146 and passes over pulleys 148 and 149 to a small drum 150 which is also coupled to the lift motor 141. Energizing the motor winds up the spread cable 151 causing it to pull the lift arm 145 away from the mattress 9 against a restraining spring 147 as the lift arm is raised. Attached to the lift arms 145 are hem guides 152 which contain guidance grooves 153 in which thickened hems 32 along each side of the transport sheet 7 slide and are captured, as described previously and shown in FIG. 10*c*. When the lift arms 145 are raised, the transport sheet 7 is lifted between the lift arms, so as to raise a reclining patient to a sitting position, as shown in FIG. 1*c*. The weight of a patient causes the transport sheet 7 to sag between the lift arms 145 during the early stages of lifting. As the lift arms approach a near-vertical position, they are spread apart by the cables 143 and 151 to tighten the lifted transport sheets and thereby bring the patient fully up to a sitting position, as shown in FIG. 1*c*.

The foot roller 5 is shown in FIG. 11 mounted on the lift frame 140, which is attached to the bed frame 27. The lift frame may extend to the head end of the bed so that the roller 6, shown in FIG. 1*a*, and the pressure controllers 101 and transfer control logic units 104, shown in FIG. 5, may also be mounted on the lift frame 140. This arrangement enables an existing bed which is equipped with air cushions to be easily modified to provide patient transfer capability as shown in FIGS. 1*a* through 1*h*. Similarly, the arrangements shown in FIGS. 8, 9, and 10 may be configured in a similar manner for easy modification of an existing bed.

The transport sheet, the roller, the lift, and the control system may all be attached to a transport frame which is attachable to the bed having inflatable air sacs with a mattress on which a person can lie.

I claim:

1. A patient care and transfer arrangement comprising:

a bed having a foot end, a head end and a plurality of inflatable air sacs comprising a mattress on which a patient may lie; a bed frame supporting said mattress; an air pump for inflating said air sacs; pressure adjustment means for regulating the pressures in said air sacs; a wheelchair removably positioned at the foot end of said bed; said wheelchair having wheels, a chair frame, a back rest and a seat; said back rest being removably insertable on said chair frame behind said person; said leg rest being movably connected to said chair frame; said leg rest being movable between a seating position sloping down from said seat and a substantially level transfer position over said seat; said mattress extending to the vicinity of and at substantially the height of the leg rest transfer position; a transport sheet extending across said mattress; roller means for moving said transport sheet and transporting a reclining person across the mattress and partly onto said leg rest; drive means for moving said leg rest from said transfer position to said seating position and thereby moving said reclining person partly onto the seat; lift means for raising said reclining person to a sitting position on the seat; a control system for regulating the operation; a mattress cover sheet extending over said inflatable air sacs and under said transport sheet for supporting said transport sheet; and tensioning means for tightening and slackening said cover sheet.

2. A patient care and transfer arrangement as defined in claim 1, wherein said inflatable air sacs are positioned with their major axes perpendicular to the major axis of the bed.

3. A patient care and transfer arrangement as defined in claim 1, wherein said inflatable air sacs are positioned with their major axes parallel to the major axis of the bed.

4. A patient transfer arrangement as defined in claim 1, wherein said lift means comprises a lift member pivotably connected to said bed frame; said mattress being supported by said lift member; a lift actuator to provide linear translation motion; said lift actuator being pivotably connected at one end to said bed frame and coupled at another end to said lift member; said lift member being rotatable by said lift actuator for raising a portion of said mattress to a substantially vertical position at the foot end of said bed.

5. A patient care and transfer arrangement as defined in claim 1, wherein said lift means include lift arms on each side of said mattress; each lift arm having a groove with a narrow outer portion through which said transport sheet can slide and a large inner portion in which a thickened edge of said transport sheet can slide and is captured; said lift arms being connected to electric drive means for raising said lift arms and thereby raising said transport sheet and a person reclining thereon to a sitting position on said chair.

6. A patient care and transfer arrangement as defined in claim 1, wherein said lift means includes lift arms on each side of said mattress; said lift arms being pivotably supported at the foot end of said bed and being connected by a supporting sheet of material underneath said transport sheet; said lift arms being coupled to drive means for raising and lowering said transport sheet and a person reclining thereon.

7. A patient care and transfer arrangement as defined in claim 1, wherein said transport sheet has thickened edges along both sides; said lift means including lift arms slidably pivoted on an axis at said foot end of the bed; said lift arms extending along opposite edges of said transport sheet; said lift arms having grooves through which said thickened hems slide; said grooves partially enclosing and holding said thickened edges so that raising said lift arms raises also said transport sheet; cables attached to said lift arms and passing over pulleys positioned above and away from the sides of said bed to a wind-up drum coupled to a lift motor; said lift arms being raised and pulled apart when said motor is actuated in one direction and thereby said transport sheet is raised and tightened between said lift arms.

8. A patient care and transfer arrangement as defined in claim 1, wherein said lift means raises and tightens a sheet for supporting and moving a reclining patient to a sitting position on a wheelchair.

9. A patient care and transfer arrangement as defined in claim 1, wherein said transport sheet, said roller means, said lift means, and said control system are attached to a transport frame; said transport frame being attachable to a bed having inflatable air sacs comprising a mattress on which a person may lie.

10. A patient care transfer arrangement as defined in claim 1, wherein part of said transport sheet comprises a fabric impermeable to liquid but permeable to air.

11. A patient care and transfer arrangement as defined in claim 1, wherein said tensioning means comprises a motor coupled to said roller for tightening said cover sheet by winding said sheet on said roller and for loosening said cover sheet by unwinding said sheet from said roller.

12. A patient care and transfer arrangement as defined in claim 1, wherein said tensioning means comprises an air bag, said cover sheet extending over said air bag; said air bag being inflatable for tightening said cover sheet.

13. A patient care and transfer arrangement as defined in claim 1, wherein a part of said mattress, including a plurality of inflatable air sacs, is liftable to a substantially vertical position to move said reclining person to a sitting position on said wheelchair; the remaining part of said mattress being unraised.

14. A patient care and transfer arrangement as defined in claim 1, wherein said mattress, including a plurality of inflatable air sacs, can be lifted to form a substantially vertical surface for moving said reclining person to a sitting position on said wheelchair.

15. A patient care and transfer arrangement as defined in claim 1, including a pressure controller for regulating and varying air pressures in said inflatable air sacs; a plurality of electrically-actuated air pressure control valves electrically connected to and controlled by the pressure controller; each said valve having an input port and an output port; each said valve being connected through its input port to said air pump and being connected through its output port to a group of said inflatable air sacs; a pressure control panel connected to said pressure controller for prescribing a program of variable air pressures for said inflatable air sacs; said pressure controller regulating the air pressures in accordance with said program; said bed having a bed elevation motor for elevating the bed; a head elevation motor for elevating a patient's head; a leg elevation motor for elevating a patient's legs; a front sheet drive motor and a rear sheet drive motor for moving said transport sheet over said mattress; a lift motor for raising a patient to a sitting position on said wheelchair; a cover sheet with tension means for tightening said cover sheet; said wheelchair having a chair motor for moving said leg rest between said seating position and said transfer position; a transfer controller; said transfer controller being connected electrically to and controlling each of said motors; tension means, and pressure controller, for regulating the operation to transfer a patient between said bed and said wheelchair; a transfer control panel for adjusting the bed and wheelchair for transferring a patient; a transfer pendant for starting and stopping the transfer of a patient; and a patient pendant for adjusting the elevations of a patient's head and legs, and the bed.

16. A patient care and transfer arrangement as defined in claim 1, including lift arms pivotably supported from said bed frame at the foot end of the bed and extending along each side of said bed; said cover sheet being attached to and partially rolled on rotatable sleeves on said lift arms; a linear actuator for providing translational motion connected through a cable to a drum; said cable being partly wound on said drum; said drum being coupled to said sleeve so that said sleeve is rotated when said cable is pulled by said linear actuator and said support sheet is thereby wound up, said lift arms and said cover sheet being raised for raising said person to a sitting position when said linear actuator is pulled further.

* * * * *